United States Patent [19]

Rusnock

[11] Patent Number: 4,684,059

[45] Date of Patent: Aug. 4, 1987

[54] CARTON CARRYING HANDLE

[75] Inventor: Kevin R. Rusnock, Boulder, Colo.

[73] Assignee: Adolph Coors Company, Golden, Colo.

[21] Appl. No.: 879,813

[22] Filed: Jun. 27, 1986

[51] Int. Cl.[4] ..... B65D 5/46

[52] U.S. Cl. ..... 229/52 B; 206/141; 206/427; 229/920

[58] Field of Search ..... 229/40, 52 B, 920; 206/141, 427, 434; 383/17, 903

[56] References Cited

U.S. PATENT DOCUMENTS

| | | | |
|---|---|---|---|
| 2,397,484 | 4/1946 | Hedrick | 229/DIG. 4 |
| 2,732,122 | 1/1956 | Bolding | 229/DIG. 4 |
| 2,758,782 | 8/1956 | Mengis | 383/903 |
| 3,112,856 | 12/1963 | MacIntosh et al. | 229/52 B |
| 4,119,268 | 10/1978 | Segura | 383/903 |

FOREIGN PATENT DOCUMENTS

| | | | |
|---|---|---|---|
| 696461 | 10/1964 | Canada | 229/40 |
| 135660 | 4/1985 | European Pat. Off. | 229/52 B |
| 1423905 | 11/1965 | France | 229/52 B |
| 6600434 | 7/1966 | Netherlands | 229/52 B |

*Primary Examiner*—Stephen Marcus
*Assistant Examiner*—Gary E. Elkins
*Attorney, Agent, or Firm*—Klaas & Law

[57] ABSTRACT

A carton having interconnected top, bottom and side walls and end closure panels is provided with a plurality of slits and fold lines in at least one of the interconnected walls so that portions of the one wall may be pushed inwardly into the carton to form handle portions facing either of the ends of the carton and is provided with J-cut portions and other slits to inhibit tearing or to direct any tearing in a desired direction.

15 Claims, 6 Drawing Figures

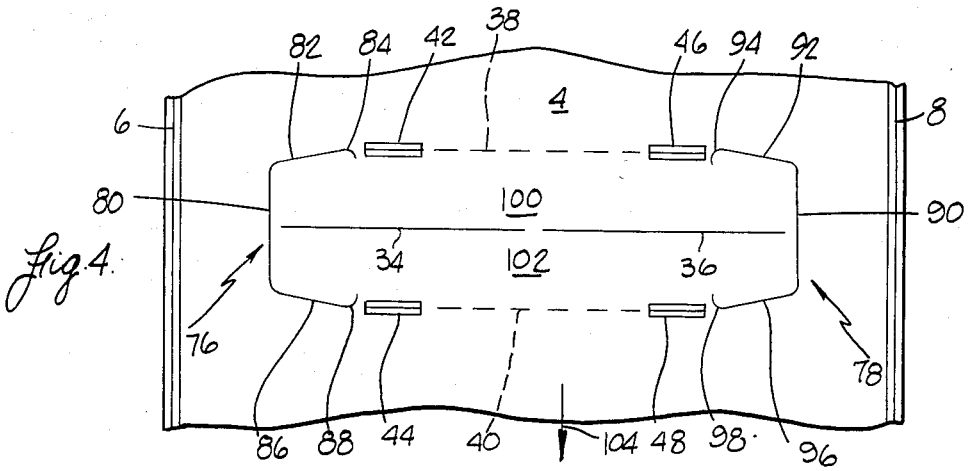
Fig. 4.
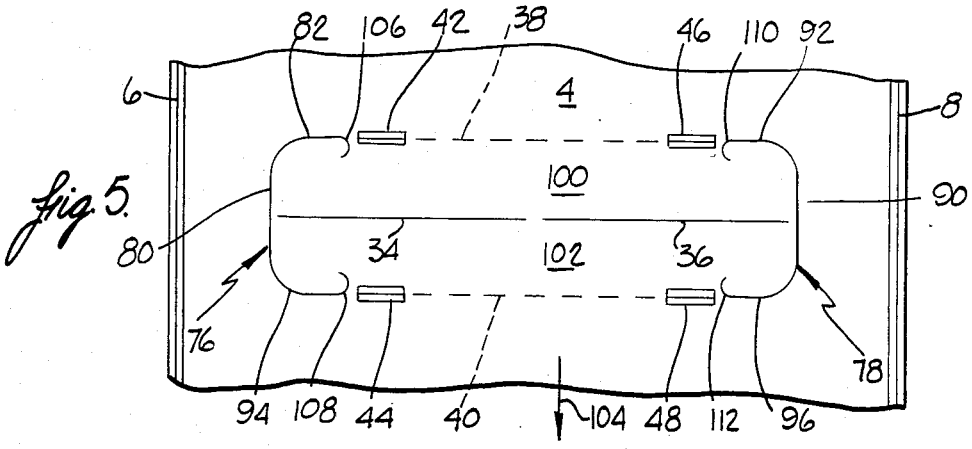
Fig. 5.
Fig. 6.
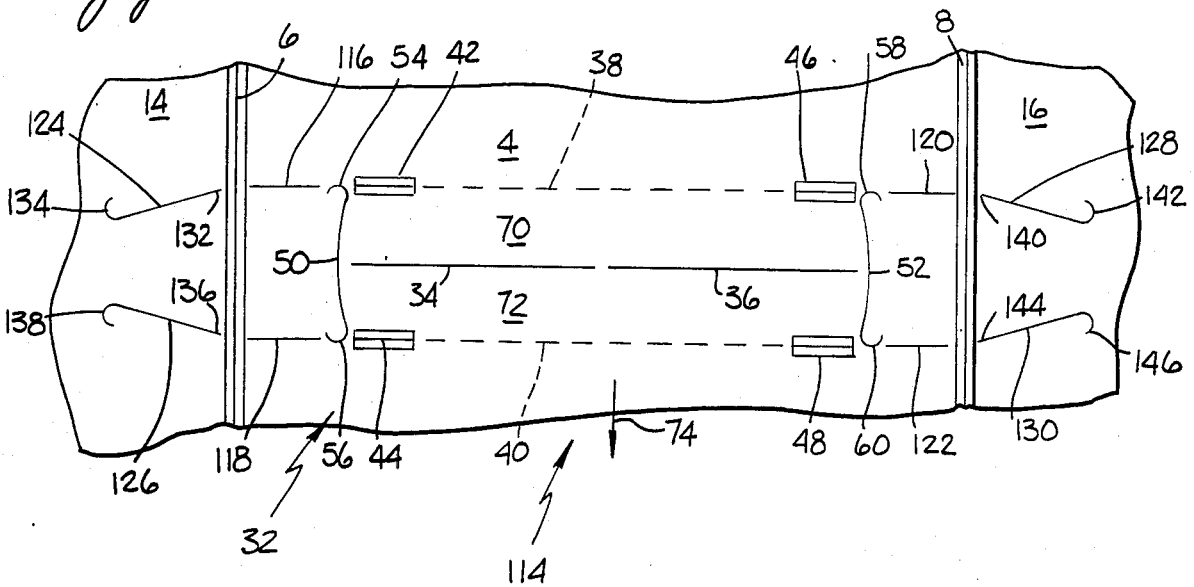

CARTON CARRYING HANDLE

FIELD OF THE INVENTION

This invention relates generally to carton used to package articles such as cans and more particularly to handles for such cartons.

BACKGROUND OF THE INVENTION

There are many cartons which have been provided with portions in one of the walls of the cartons that may be pushed inwardly into the carton to form a handle therefor. However, as in other fields, there always exists a desire to make improvements in these handles.

BRIEF DESCRIPTION OF THE INVENTION

This invention provides a carrying handle for a carton wherein all of the slits and fold lines for the handle may be formed in one wall of the carton and portions of the one wall may be readily pushed into the carton so that the fingers of the user may be directed toward either of the ends of the carton. In one embodiment of the invention, a pair of terminal slits are in each of the walls connected to the one wall along common longitudinal edges.

In one embodiment of the invention the carrying handle is formed in one wall of a carton having interconnected top, bottom and side walls and end closure panels. The one wall having opposed edges has a longitudinal extent greater than its transverse extent and is provided with a pair of equal length, spaced apart, transverse, linear, aligned slits. A pair of fold lines are formed in the one wall on opposite sides of the pair of slits with the fold lines being generally parallel to the pair of slits. The pair of fold lines have scored end portions spaced from the longitudinal edges of the one wall. A pair of end slits are formed in the one wall and have portions thereof which extend between and are in close proximity to the scored end portions of the fold lines so that portions of the one wall may be readily pushed inwardly into the cartons to form a carrying handle for the carton. The end slits terminate in J-cut portions so as to inhibit tearing of the material in the one wall. The fingers of the user may be inserted into the carton at the pair of slits and be directed toward either of the ends of the carton. In one embodiment of the invention, the J-cut portions extend in a direction toward one of the longitudinal edges. Also, a first pair and a second pair of side slits are formed in the one wall with each of the side slits extending between and in close proximity to one of the J-cut portions and one of the longitudinal edges so that any tearing will be in a desired direction.

It is an object of this invention to provide one of the walls of a carton with slits and fold lines so that a carrying handle may be readily formed therein.

Additional objects, advantages, and novel features of the invention are set forth in part in the description which follows which will be understood by those skilled in the art upon examination of the following or may be learned by practice of the invention. The objects and advantages of the invention may be realized and obtained by means of the instrumentalities and combinations particularly pointed out in the appended claims.

BRIEF DESCRIPTION OF THE DRAWING

FIGS. 3–5 are top plan views of other embodiments of the invention; and

FIG. 6 is a top plan view of a portion of a carton blank illustrating another embodiment of the invention.

DETAILED DESCRIPTION OF THE INVENTION

Figure 1:
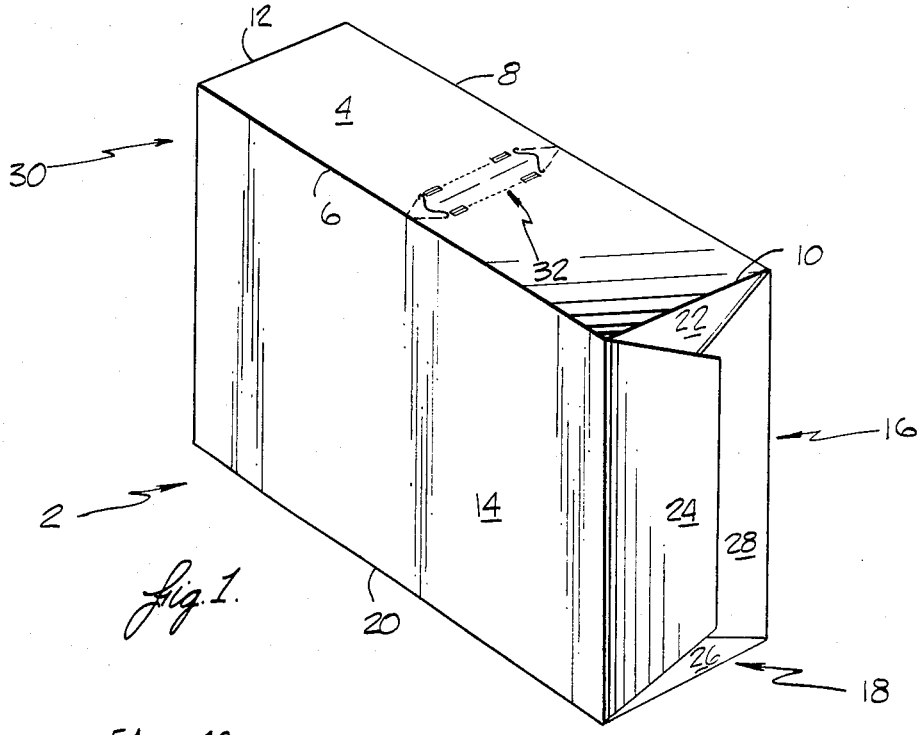
FIG. 1 is a pictorial view of a carton having a carrying handle of one embodiment of the invention.

The carton 2 illustrated in FIG. 1 has a top wall 4 having opposed longitudinal edges 6 and 8 and opposed transverse edges 10 and 12. The longitudinal edges 6 and 8 are longer than the transverse edges 10 and 12. A side wall 14 is connected to the top wall 4 by the common longitudinal edge 6 and a side wall 16 is connected to the top wall 4 by the common longitudinal edge 8. The side wall 14 is connected to a bottom wall 18 by a common longitudinal edge 20. The side wall 16 is connected to the bottom wall 18 by a common longitudinal edge (not shown). End closure panels 22, 24, 26 and 28 are connected respectively to top wall 4, side wall 14, bottom wall 18 and side wall 16 by common edges. Similar end closure panels (not shown) are provided for the other end 30 of the carton 2.

Figure 2:
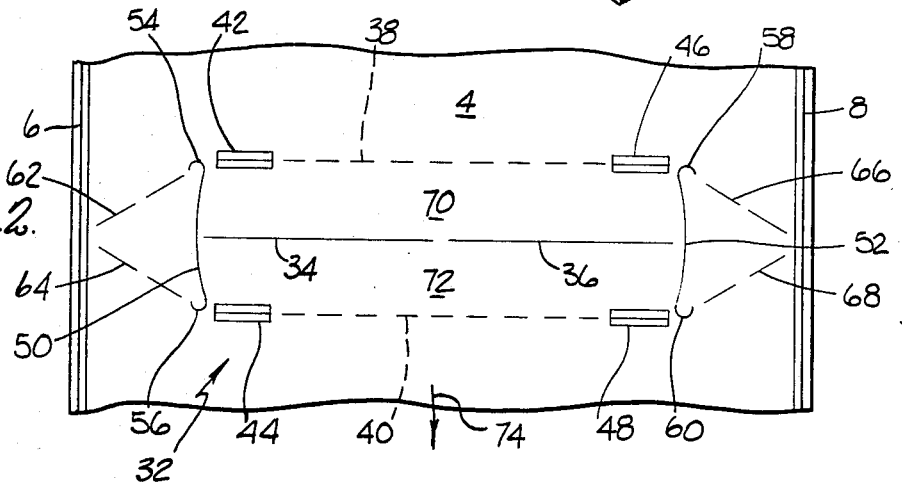
FIG. 2 is an enlarged top plan view of the portion of the carton having the carrying handle.

The carrying handle portion 32 for the carton 2 of FIG. 1 is illustrated in an enlarged top plan view in FIG. 2. A pair of slits 34 and 36 are formed in the top wall 4. As illustrated, the pair of slits 34 and 36 are of equal length, are spaced apart, are transverse, are linear and are aligned. A pair of perforated fold lines 38 and 40 are on opposite sides of the pair of slits 34 and 36 and are parallel to them. The pair of fold lines 38 and 40 have scored end portions 42 and 44 closer to the longitudinal edge 6 and a pair of scored end portions 46 and 48 closer to the longitudinal edge 8 to facilitate folding around the perforated fold lines 38 and 40. A pair of end slits 50 and 52 are provided in the top wall 4 with the end slit 50 extending between and having portions in close proximity to the end portions 42 and 44 and the end slit 52 extending between and having portions in close proximity to the end portions 46 and 48. The end slit 50 has J-cut portions 54 and 56 extending toward the longitudinal edge 6 and the end slit 52 has J-cut portions 58 and 60 extending toward the longitudinal edge 8. A first pair of side slits 62 and 64 are formed in the top wall 4 with the side slit 62 extending between and in close proximity to the J-cut portion 54 and the longitudinal edge 6 and with the side slit 64 extending between and in close proximity to the J-cut portion 56 and the longitudinal edge 6. A second pair of side slits 66 and 68 are formed in the top wall 4 with the side slit 66 extending between and in close proximity to the J-cut portion 58 and the longitudinal edge 8 and with the side slit 68 extending between and in close proximity to the J-cut portion 60 and the longitudinal edge 8. As illustrated in FIG. 2, the side slits 62, 64, 66 and 68 each comprises a pair of equal length, spaced apart, linear, aligned slits. The side slits 62 and 64 are inclined relative to each other so that the end portions thereof in close proximity to the J-cut portions 54 and 56 are spaced apart a greater distance than the end portions thereof in close proximity to the longitudinal edge 6. Also, the side slits 66 and 68 are inclined relative to each other so that the end portions thereof in close proximity to the J-cut portions 58 and 60 are spaced apart a greater distance than the end portions thereof in close proximity to the longitudinal edge 8.

The carrying handle for the carton 2 of the embodiment illustrated in FIG. 2, is formed by the user applying an inwardly directed force with his fingers to either the handle portion 70 between the slits 34 and 36 and the fold line 38 or the handle portion 72 between the slits 34 and 36 and the fold line 40. If the force is applied to the handle portion 72, it will tear along the slits 34 and 36 and then along the end slits 50 and 52 toward the scored end portions 44 and 48. The continued application of the force will fold the handle portion 72 around the fold line 40 until contact is made with the bottom surface (not shown) of the top wall 4. If the fingers of the user are sufficiently large, a smaller force would also be applied to the portion 70 to cause some tearing along the end slits 50 and 52 toward the scored end portions 42 and 46 and some folding of the handle portion 70 around the fold line 38. The J-cut portions 56 and 60 are designed to inhibit tearing of the top wall 4 in the direction of the arrow 74 and to direct any tearing to the side slits 64 and 68 toward the longitudinal edges 6 and 8. If the main force is applied to the handle portion 70, it will function in a similar manner in the opposite direction.

Figure 3:
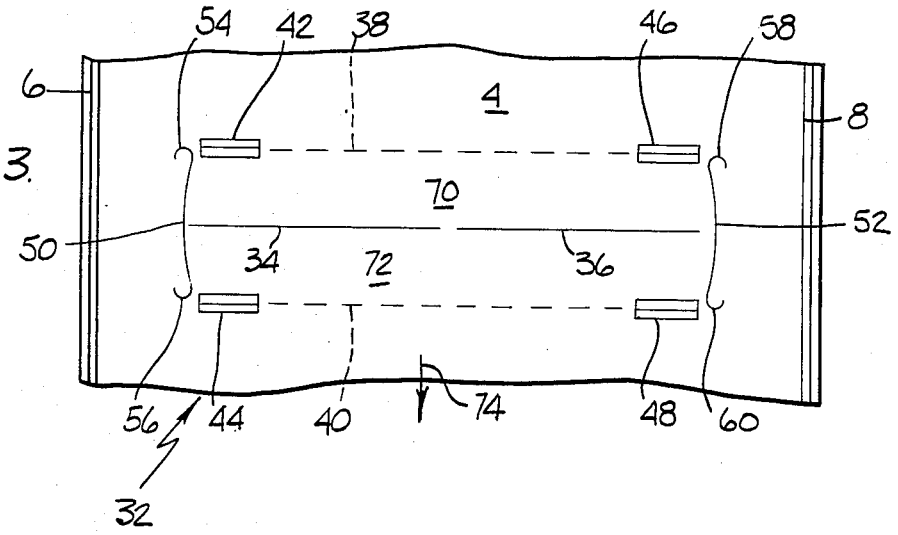

The embodiment illustrated in FIG. 3 is similar to that illustrated in FIG. 2 and the corresponding parts have been identified with the same reference numbers. The embodiment of FIG. 3 does not have the end slits 62, 64, 66 and 68 and would be used in those instances wherein the material in the top wall 4 has a greater resistance to tearing. With the exception of the functions relating to the side slits 62, 64, 66 and 68, the embodiment in FIG. 3 functions substantially in the same manner as the embodiment of FIG. 2.

The embodiment illustrated in FIG. 4 differs from the embodiment in FIG. 3 primarily in the shape of the end slits 76 and 78 which are generally C-shaped with the open ends thereof facing each other and corresponding parts have been identified with the same reference numbers. The end slit 76 has a central portion 80 which is generally parallel to the longitudinal edge 6, a transversely extending portion 82 terminating in a J-cut portion 84 and a transversely extending portion 86 terminating in a J-cut portion 88. The end slit 78 has a central portion 90 which is generally parallel to the longitudinal edge 8, a transversely extending portion 92 terminating in a J-cut portion 94 and a transversely extending portion 96 terminating in a J-cut portion 98. The J-cut portions 84, 88, 94 and 98 have an arcuate extent of less than about 90 degrees.

The carrying handle for the carton 2 of the embodiment illustrated in FIG. 4 is formed by the user applying an inwardly directed force with his fingers to either the handle portion 100 between the slits 34 and 36 and the fold line 38 or the handle portion 102 between the slits 34 and 36 and the fold line 40. If the force is applied to the handle portion 102, it will tear along the slits 34 and 36 and then along the central portions 80 and 90 toward the transversely extending portions 86 and 96. The continued application of the force will fold the handle portion 102 around the fold line 40 until contact is made with the bottom surface (not shown) of the top wall 4. If the fingers of the user are sufficiently large, a smaller force would also be applied to the portion 100 to cause some tearing along the central portions 80 and 90 toward the transversely extending portions 82 and 92 and some folding of the handle portion 102 around fold line 38. The J-cut portions 88 and 98 are designed to inhibit tearing of the top wall 4 in the direction of the arrow 104. If the main force is applied to the handle portion 100, it will function in a similar manner in the opposite direction.

The embodiment illustrated in FIG. 5 is similar to the embodiment illustrated in FIG. 4 and the corresponding parts have been identified with the same reference numbers. There is a slight change in the shape of the C-shaped end slits 76 and 78. The most significant change in the embodiment of FIG. 5 in relation to the embodiment of FIG. 4 is the shape of the J-cut portions 106, 108, 110 and 112 which have an arcuate extent greater than 90 degrees. The embodiment of FIG. 5 functions substantially in the same manner as the embodiment of FIG. 4.

In FIG. 6, there is illustrated a portion of a carton blank 114 prior to being folded into a carton and illustrating another embodiment of the carrying handle portion 32. The embodiment illustrated in FIG. 6 is similar to the embodiment illustrated in FIG. 2 except for the side slits 116, 118, 120 and 122 and the addition of the additional slits 124 and 126 in the side wall 14 and the additional slits 128 and 130 in the side wall 16. The side slit 116 extends between and has end portions in close proximity to the J-cut portion 54 and the longitudinal edge 6 and is linear and generally aligned with the fold line 38. The side slit 118 extends between and has end portions in close proximity to the J-cut portion 56 and the longitudinal edge 6 and is linear and generally aligned with the fold line 40. The side slit 120 extends between and has end portions in close proximity to the J-cut portion 58 and the longitudinal edge 8 and is linear and generally aligned with the fold line 38. The side slit 122 extends between and has end portions in close proximity to the J-cut portion 60 and the longitudinal edge 8 and is linear and generally aligned with the fold line 40. The additional slit 124 has an end portion 132 in close proximity to the longitudinal edge 6 and generally in alignment with the side slit 116 and terminates in a J-cut portion 134. The additional slit 126 has an end portion 136 in close proximity to the longitudinal edge 6 and generally in alignment with the side slit 118 and terminates in a J-cut portion 138. The additional slit 128 has an end portion 140 in close proximity to the longitudinal edge 8 and generally in alignment with the side slit 120 and terminates in a J-cut portion 142. The additional slit 130 has an end portion 144 in close proximity to the longitudinal edge 8 and generally in alignment with the side slit 122 and terminates in a J-cut portion 146. The end portions 132 and 136 are spaced apart a greater distance than the J-cut portions 134 and 138. Also, the end portions 140 and 144 are spaced apart a greater distance than the J-cut portions 142 and 146. When the side wall portions 14 and 16 are folded to form a carton 2, they are perpendicular to the top wall 4 so that the additional slits 124, 126, 128 and 130 are respectively perpendicular to the side slits 116, 118, 120 and 122.

The embodiment of FIG. 6 functions substantially in the same manner as the embodiment of FIG. 2 when an inwardly directed force is applied to the handle portion 72 until the handle portion 72 has contacted the bottom surface of the top wall 4. If the J-cut portions 56 and 60 do not inhibit tearing in the direction of the arrow 74, they direct any tearing to the side slits 118 and 122 and if further tearing occurs, it is directed to the additional slits 126 and 130 to be inhibited by the J-cut portions 138 and 146. As stated above, if the main force is applied to the handle portion 70, it will function in a similar manner in the opposite direction.

It is contemplated that the inventive concepts herein described may be variously otherwise embodied and it is intended that the appended claims be construed to include alternative embodiments of the invention except insofar as limited by the prior art.

What is claimed is:

1. A carrying handle for a carton having interconnected top, bottom side walls and end closure panels comprising:

a plurality of spaced apart, transverse, linear aligned slits in one of said interconnected walls, said one wall having opposed longitudinal edges and having a longitudinal extend greater than its transverse extent;

a pair of linear fold lines on opposite sides of said plurality of slits and parallel to said plurality of slits;

said fold lines having scored end portions spaced from one and the other of said longitudinal edges;

a pair of end slits having portions thereof extending between and in close proximity to said scored end portions of said fold lines so that a portion of said one wall may be pushed inwardly into said carton and folded around one of said fold lines to form a carrying handle;

each of said pair of end slits having J-cut portions extending toward one of said longitudinal edges; and a first pair of side slits and a second pair of side slits, each side slit extending between and in close proximity to one of said J-cut portions and said one or said other of said longitudinal edges.

2. A carrying handle as in claim 1 and further comprising:

each of said side slits comprising a pair of equal length, spaced apart, linear, aligned slit.

3. A carrying handle as in claim 2 and further comprising:

each pair of side slits are inclined relative to each other so as to have first end portions which are in close proximity to said J-cut portions spaced apart a greater distance than second end portions which are in close proximity to said one or said other of said longitudinal edges.

4. A carrying handle as in claim 3, wherein:

said plurality of slits are two and are of equal length.

5. A carrying handle as in claim 4 wherein:

each of said fold lines between said scored end portions is perforated.

6. A carrying handle as in claim 1 and further comprising:

a pair of terminal slits in said interconnected wall extending from said one of said longitudinal edges; and a pair of terminal slits in said interconnected wall extending from said other of said longitudinal edges.

7. A carrying handle as in claim 6 and further comprising:

each of said terminal slits having a first end portion spaced spaced from one of said longitudinal edges and a second end portion spaced from said one of said longitudinal edges a distance greater than the distance said first end portion is spaced from said one of said longitudinal edges; and said second end portion is a J-cut portion.

8. A carrying handle as in claim 7 wherein:

said plurality of slits are two and are of equal length.

9. A carrying handle as in claim 8 wherein:

each of said fold lines between said scored end portions is perforated.

10. A carrying handle for a carton having interconnected top, bottom, side walls and end closure panels comprising:

a plurality of equal length, spaced apart, transverse, linear, aligned slits in one of said interconnected walls, said one wall having opposed longitudinal edges and having a longitudinal extend greater than its transverse extent;

a pair of linear fold lines on opposite sides of said plurality of slits and parallel to said plurality of slits;

said fold lines having scored non-perforated end portions spaced from one and the other of said longitudinal edges;

a pair of end slits extending generally in a longitudinal direction, one of said end slits extends between and is in close proximity to said scored non-perforated end portions of said fold lines spaced from said one of said longitudinal edges and the other of said end slits extends between and is in close proximity to said scored non-perforated end portions of said fold lines spaced from said other of said longitudinal edges so that said scored non-perforated end portions are between said perforated portions of said fold lines and said end slits so that a portion of said one wall may be pushed inwardly into said carton and folded around one of said fold lines to form a carrying handle and said plurality of slits and said fold lines with said scored non-perfrated end portions being located between said end slits so that, when an inwardly directed force is applied to a portion of said one wall between said plurality of slits, said end slits and one of said fold lines, said portion will separate only along said plurality of slits and parts of said end slits and fold around said one fold line.

11. A carrying handle as in claim 10 and further comprising:

each of said pair of end slits having J-cut portions extending toward said one or said other of said longitudinal edges.

12. A carrying handle as in claim 10 and further comprising:

each of said end slits are generally C-shaped with the open portions thereof facing each other.

13. A carrying handle as in claim 12 and further comprising:

each end portion of said C-shaped end slit is a J-cut portion.

14. A carrying handle as in claim wherein:

said plurality of slits are two.

15. A carrying handle as in claim 14 wherein:

said J-cut portion is greater than 90 degrees.

* * * * *

UNITED STATES PATENT AND TRADEMARK OFFICE

CERTIFICATE OF CORRECTION

PATENT NO. : 4,684,059

DATED : August 4, 1987

INVENTOR(S) : KEVIN R. RUSNOCK

It is certified that error appears in the above-identified patent and that said Letters Patent are hereby corrected as shown below:

Claim 1, Col. 5, line 13, "extend" should read --extent--.

Claim 7, Col. 5, line 61, "spaced" (2nd instance) should be deleted.

Claim 10, Col. 6, line 15, "extend" should read --extent--;
line 22, after "edges", --and perforated portions between said scored non-perforated end portions-- should have been inserted; and
line 39, "non-perfrated" should read --non-perforated--.

Signed and Sealed this

Eighth Day of December, 1987

*Attest:*

DONALD J. QUIGG

*Attesting Officer*

*Commissioner of Patents and Trademarks*